US005328544A

United States Patent [19]

Weinert

[11] Patent Number: 5,328,544

[45] Date of Patent: Jul. 12, 1994

[54] SYSTEM FOR APPLYING ADHESIVE TO SHEET MATERIAL

[75] Inventor: Lawrence E. Weinert, Antioch, Calif.

[73] Assignee: James River Paper Companey, Inc., Richmond, Va.

[21] Appl. No.: 49,397

[22] Filed: Apr. 21, 1993

[51] Int. Cl.[5] ..... B43M 11/00

[52] U.S. Cl. ..... 156/578; 156/441.5; 118/205; 401/264

[58] Field of Search ..... 156/578, 441.5; 118/205, 240, 419; 401/231, 264

[56] References Cited

U.S. PATENT DOCUMENTS

| | | | |
|---|---|---|---|
| 378,742 | 2/1988 | Underwood | 401/264 |
| 2,063,617 | 12/1936 | Nealand | 401/264 |
| 2,361,795 | 10/1944 | Roesen | 242/56 |
| 3,470,052 | 9/1969 | Herman | 156/184 |
| 3,505,150 | 4/1970 | Andersson | 156/187 |
| 3,532,573 | 10/1970 | Herman | 156/184 |
| 3,761,300 | 9/1973 | Huffman et al. | 118/101 X |
| 4,026,752 | 5/1977 | Hartbauer et al. | 156/457 |
| 4,370,193 | 1/1983 | Knauthe | 156/446 |
| 4,502,912 | 3/1985 | Steiner et al. | 156/548 |
| 4,878,981 | 11/1989 | Mizutani | 156/356 |
| 4,897,145 | 1/1990 | Marzullo | 156/422.1 |
| 4,963,223 | 10/1990 | Biagotti | 156/456 |

*Primary Examiner*—David A. Simmons
*Assistant Examiner*—James J. Engel, Jr.
*Attorney, Agent, or Firm*—Thomas R. Lampe

[57] ABSTRACT

Apparatus for applying adhesive to sheet material includes an adhesive applicator including a holder with two relatively moveable segments and a tube connected to the segments having a dispensing slit which is opened and closed due to relative movement between the segments.

10 Claims, 3 Drawing Sheets

SYSTEM FOR APPLYING ADHESIVE TO SHEET MATERIAL

TECHNICAL FIELD

This invention relates to a system for applying for applying adhesive to sheet material. The particular form of the apparatus disclosed herein is employed to apply glue to sheet material in the form of a band which is employed to wrap a bundle of products such as folded paper towels. However, the apparatus may be utilized in any manufacturing or operational context wherein adhesive or glue is to be applied to sheet material.

BACKGROUND ART

Many arrangements exist in the prior art for applying glue to sheet material. For example, there are many paper converting and packaging operations which call for the application of adhesive to either the product itself or to bands or other wraps employed in the packaging of the products. In the former category, it is well known to apply glue to the tail end of a wound web, such as a tissue or towel roll, to secure the tail in position relative to the rest of the product. Insofar as packaging is concerned, bands of paper or other sheet material are often utilized to secure together a bundle of products, such as a stack of paper towels or napkins. The embodiment of the invention disclosed herein has application to wrap bands; however, as noted above, the invention has application in a wide variety of operational environments wherein glue is applied to sheet material.

Adhesive is primarily conventionally applied by either glue applicator wheels, brushes, or through the use of glue jets or nozzles which direct the adhesive to the desired location. These prior art approaches have a number of disadvantages. For example, glue applicator equipment is often relatively complex and expensive. Furthermore, glue applicator equipment employing either glue wheels, brushes or glue jets can become clogged and even inoperable over time, particularly when the adhesive has time to harden. Also, some approaches have the additional drawback of wasting glue. Use of adhesive applicator nozzles requires high operating adhesive pressures with attendant problems.

A search of the prior art located the following U.S. Pat. Nos.: 4,963,223, issued Oct. 16, 1990, No. 4,026,752, issued May 31, 1977, No. 2,361,795, issued Oct. 31, 1944, No. 4,897,145, issued Jan. 30, 1990, No. 3,761,300, Sep. 25, 1973, No. 4,878,981, issued Nov. 7, 1989, No. 3,532,573, issued Oct. 6, 1970, No. 4,502,912, issued Mar. 5, 1985, No. 3,505,150, issued Apr. 7, 1970, No. 4,370,193, issued Jan. 25, 1983, and No. 3,470,052, issued Sep. 30, 1969.

The above-identified patents are believed to be representative of the types of arrangements employed to apply glue to sheet material and related products.

DISCLOSURE OF INVENTION

The present invention relates to apparatus which inexpensively, efficiently, and effectively applies adhesive to sheet material. The apparatus has a high degree of reliability and is not prone to clogging by the adhesive. In addition, the apparatus operates under extremely low adhesive pressures, which of course is not the case with respect to any system employing jets or nozzles to spray or direct adhesive to the sheet material.

The present apparatus functions in a unique manner to not only make efficient use of the adhesive on the sheet material but to actually utilize the cooperative relationship between the sheet material and the apparatus to keep the apparatus clean and relatively free of glue build-up. The structural elements of the apparatus also operate to break up any glue which may have hardened on the apparatus so that there is no interference with proper operation of the apparatus, even after an extended period of down time.

The apparatus for applying adhesive to sheet material constructed in accordance with the teachings of the present invention includes adhesive applicator means having a contact surface engageable with said sheet material and defining a slit at the contact surface. The adhesive applicator means selectively has either a first configuration wherein the slit is closed or a second configuration wherein the slit is opened.

Passageway defining means defines a passageway extending between a source of adhesive and the slit.

Actuator means is in operative association with the adhesive applicator system to change the adhesive applicator system from the first configuration to the second configuration for delivering adhesive from the passageway to the contact surface through the open slit.

The adhesive applicator means includes a holder element defining an opening at the contact surface and a hollow flexible element mounted on the holder element. The slit is formed in the hollow flexible element and the slit is closely adjacent to and in at least partial registry with the opening.

As disclosed herein, the hollow flexible element comprises a tube, the tube extending from the holder element and comprising at least a portion of the passageway defining means.

The holder element includes a first holder element segment and a second holder element segment. The holder element segments are pivotal relative to each other about a predetermined pivot axis. The hollow flexible element has separate sections thereof fixedly mounted on each of the holder element segments. Relative pivotal movement between the holder element segments is operable to bend the hollow flexible element to selectively open or close the slit.

Other features, advantages, and objects of the present invention will become apparent with reference to the following description and accompanying drawings.

BEST MODE FOR CARRYING OUT THE INVENTION

Figure 1:
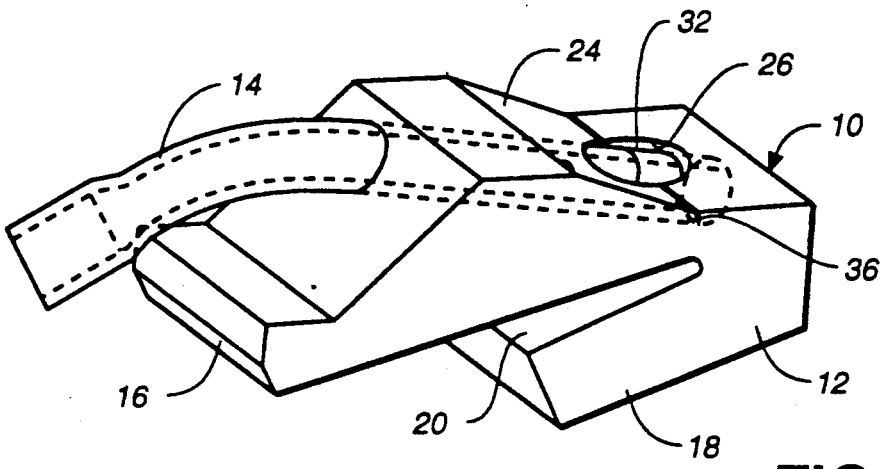
FIG. 1 is a perspective view of an adhesive applicator constructed in accordance with the teachings of the present invention.

Referring now to the drawings, apparatus constructed in accordance with the teachings of the present invention includes an adhesive applicator 10 including a holder element 12 and a hollow flexible element or tube 14. Tube 14 is constructed of a suitable pliant material such as plastic or rubber.

In the embodiment illustrated, holder element 12 is of unitary construction, a suitable material for such construction being a flexible plastic, such as a fluoroplastic. The holder element 12 includes a first segment 16 and a second segment 18 divided by a groove 20.

Figure 2:
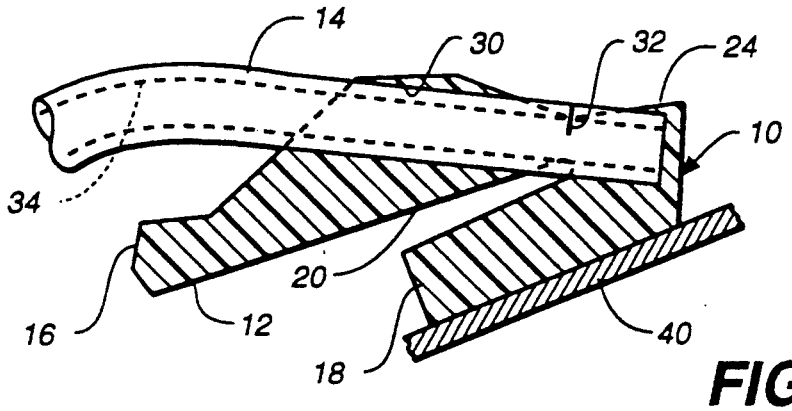
FIG. 2 is a side, cross-sectional view of the adhesive applicator in a first configuration.
Figure 3:
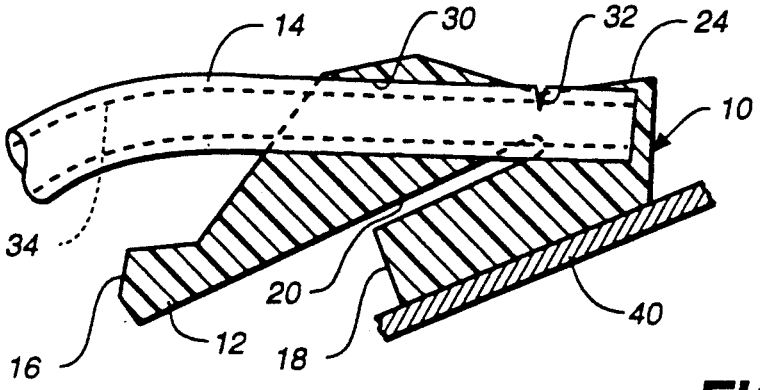
FIG. 3 is a view similar to FIG. 2 but illustrating the adhesive applicator in a second configuration.

The first and second holder element segments 16, 18 normally assume the relative positions shown in FIGS. 1 and 2 but can move to the relative positions shown in FIG. 3 upon application of suitable opposed forces on the first and second holder element segments. That is, the holder element segments are pivotal relative to each other about a pivot axis located at the internal end of groove 20.

The first holder element segment 16 has a contact surface having two planar portions defining a notch 24. An opening 26 is formed in the first holder element segment where the contact surface segments defining notch 24 converge. That is, the notch has a generally V-shaped configuration and the opening 26 is located at the point of convergence of the V-shaped notch.

A hole 30 extends part way into the holder element 12 through first holder element segment 16 and to a degree into second holder element segment 18 wherein the hole terminates. Elongated hole 30 communicates with opening 26 and houses therein the tube 14. The second holder element segment 18 and tube 14 cooperate to seal off the open end of the tube.

A slit 32 is formed in the tube, as shown. The slit only extends part way through the tube but the depth of the slit is enough to provide communication with the interior passageway 34 of the tube. The slit 32 is in alignment with a cut 36 made at the point of intersection of the planar surfaces defining notch 24. This cut facilitates relative movement between the first and second holder element segments when the segments move from the relative position shown in FIGS. 1 and 2 to that illustrated in FIG. 3.

Tube 14, as shown in FIGS. 4–7, extends to a distribution manifold 38 which defines an interior holding an adhesive, such as a dextrin adhesive. A representative example of such adhesive is H.B. Fuller #0359-E adhesive. The distribution manifold 38 may, if desired, be in operative association with other adhesive applicators (not shown). A suitable source of adhesive (not shown) provides adhesive under low pressure to the distribution manifold.

Figure 5:
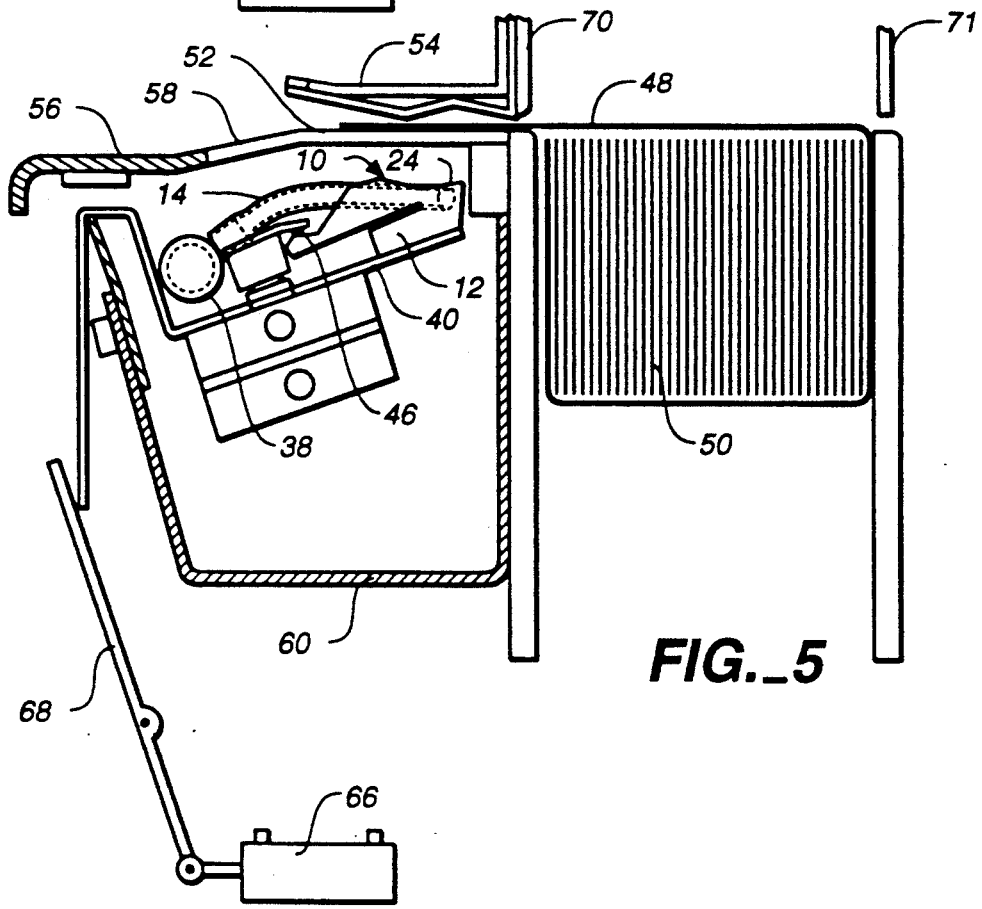
Figure 6:
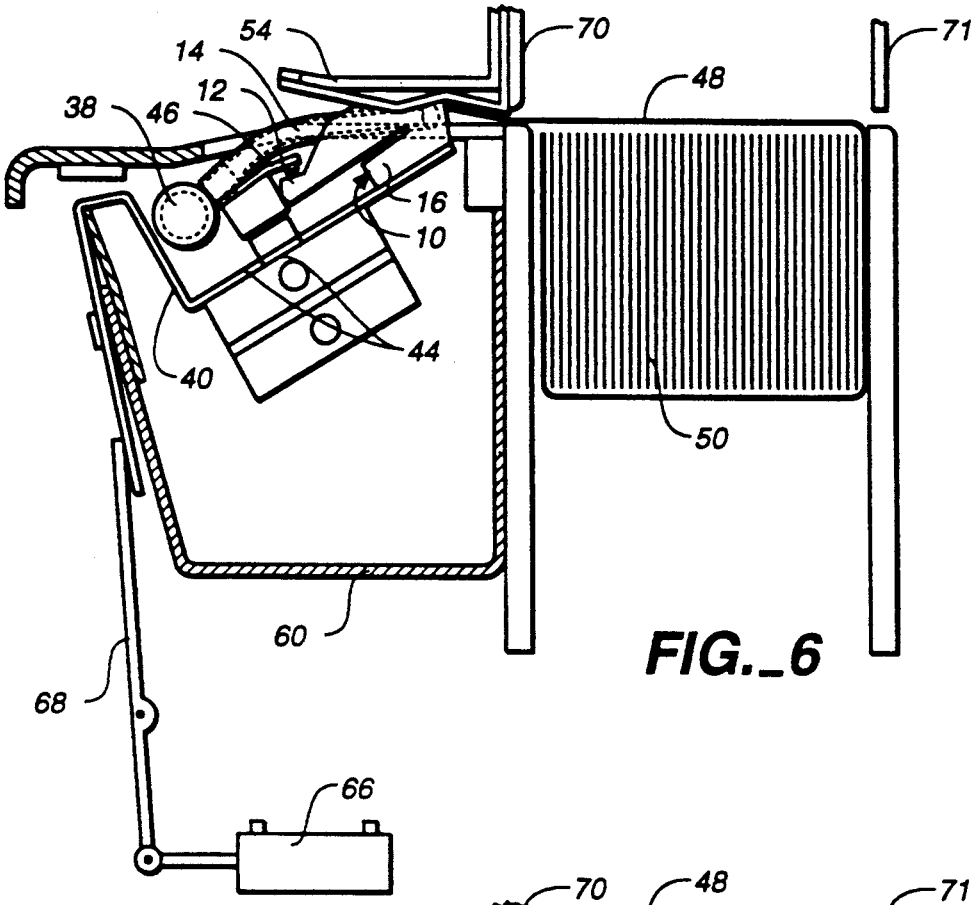

When the slit 32 in tube 14 is closed, that is when the segments of the holder element are in the positions shown in FIGS. 1 and 2, no adhesive will exit the slit, the tube in effect, forming a valve which is closed. When, however, the first holder element segment and the second holder element segment assume the relative positions shown in FIG. 3, the slit 32 is open, and adhesive will exit the slit to deliver a quantity thereof to the contact surface defining notch 24 in the first holder element segment. Any suitable arrangement may be employed to effect this relative movement between the first and second holder element segments. In the arrangement illustrated, the second holder element segment 18 is mounted on a support 40. An air cylinder 42 is also mounted on support 40, the armature 44 thereof having an actuator arm 46 at its end. When the armature 44 is extended, the actuator arm 46 will be positioned adjacent to, but not in engagement with, the distal end of first holder element segment 16. When, however, the armature 44 is retracted, actuator arm 46 engages the distal end of the first holder element segment 16 (as shown in FIG. 5) and causes relative movement between the first and second holder element segments to dispense adhesive through the slit 32.

FIGS. 4 through 7 show the sequence of operations being carried out when utilizing the adhesive applicator 10 to apply adhesive to the securement band 48 utilized to secure together or wrap a bundle 50 of products such as paper towels, napkins or the like.

Figure 4:
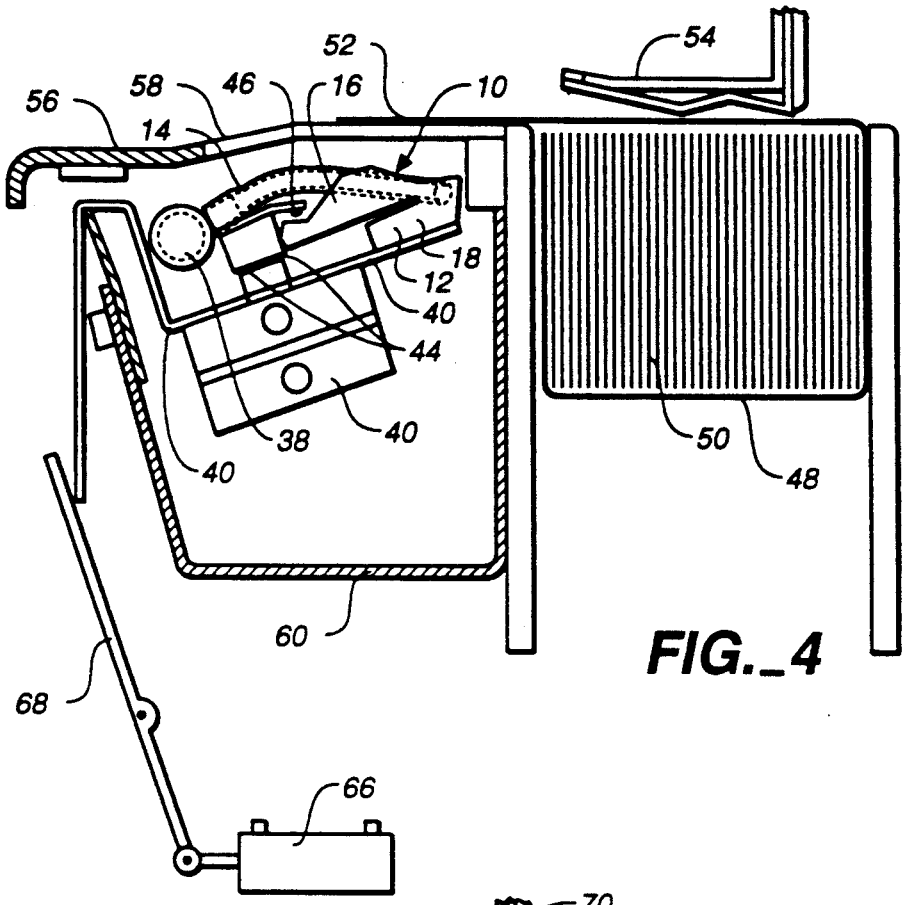
FIGS. 4 through 7 are somewhat diagrammatic presentations of apparatus constructed in accordance with the teachings of the present invention, including the adhesive applicator component, being utilized to apply glue to a wrapper band for a bundle of products, the FIGURES illustrating the relative positions assumed by the structural components of the apparatus during sequential stages of operation.

In FIG. 4, a terminal or free end 52 of the band is shown just prior to placement thereof between the adhesive applicator 10 and sheet material engagement means 54. The bottom of sheet material engagement means 54 has a cross-sectional configuration generally corresponding to the cross-sectional configuration of notch 24. The sheet material engagement means is for the purpose of engaging sheet material and define a nip with the contact surface of the first holder element segment to maintain the free end of the band in contact with the contact surface.

As shown in FIG. 4, the free end 52 of band 48 is positioned on a table element 56. An aperture 58 is formed in table element 56 above the adhesive applicator 10.

After the free end of band 52 is positioned on table element 56 as shown in FIG. 4, the entire arrangement (with the exception of sheet material engagement means 54, which is fixed in place) shifts to the right to bring free end 52 and adhesive applicator 10 under sheet material engagement means 54 with a space therebetween, as shown in FIG. 5. The holder element 12 is flexed to dispense adhesive through slit 32 onto the surfaces defining notch 24. The entire adhesive applicator 10 is then moved to the position shown in FIG. 6 so that the free end 52 of band 48 is located within a nip defined by sheet material engagement means 54 and the adhesive applicator. At this stage of the operation, the actuator arm 46 has moved back to its extended position and the first and second holder element segments have returned to their normal or unflexed condition.

Any suitable means may be employed to move the adhesive applicator 10 relative to the sheet material engagement means 54. In the present instance, the support 40 loops over the edge of a structural member 60 and is pivotal relative thereto. An air cylinder 66 has the armature thereof connected to a lever 68 which is engageable with the distal end of the support 40 outside the structural member 60. Extension of the arm of air cylinder 66 will cause the lever 68 to engage the distal end of support 40 and pivot the adhesive applicator 10 upwardly toward sheet material engagement means 54 as shown.

Figure 7:
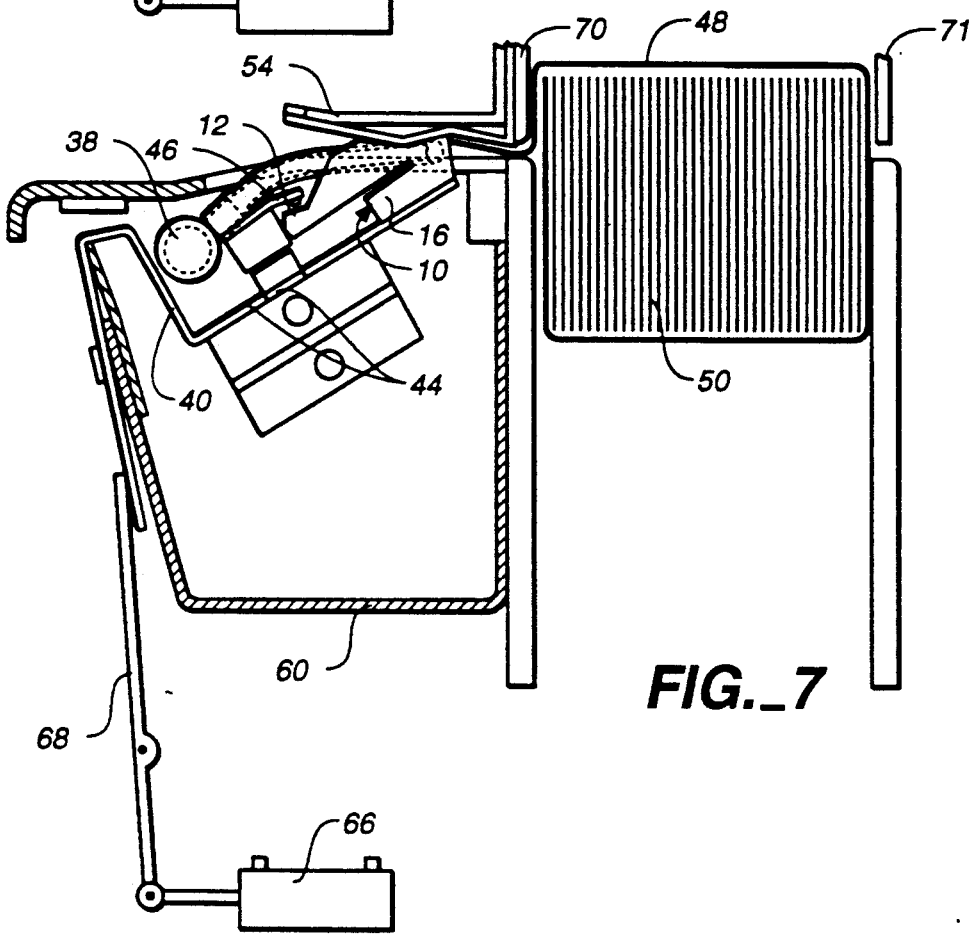

After the nip is formed between the sheet material engagement means 54 and the holder element 12, the bundle 50 is moved upwardly as shown in FIG. 7 within the walls 70, 71 of a drying chamber. This movement brings the free end 52 of the band 48 into engagement with the other end of the band. The free end 52 will have adhesive applied thereto as it is drawn through the nip formed by holder element 12 and sheet material engagement means 54. This adhesive will be pressed into position between the two ends of the band whereby securement therebetween is accomplished.

As noted above, very little head pressure is required for the present arrangement to be utilized to dispense adhesive. Another desirable result is obtained due to the fact that movement of the band free end 52 through the nip will tend to keep the nip area relatively clean. In the event there is some degree of adhesive build-up at the slit 32 on tube 14, opening of the slit will tend to break or remove any obstruction formed thereby, even when the adhesive has had a chance to harden.

I claim:

1. Apparatus for applying adhesive to sheet material, said apparatus comprising, in combination:

adhesive applicator means having a contact surface engageable with said sheet material and defining a slit at said contact surface, said adhesive applicator means selectively having either a first configuration wherein said slit is closed or a second configuration wherein said slit is open;

passageway defining means defining a passageway extending between a source of adhesive and said slit; and actuator means in operative association with said adhesive applicator system to change said adhesive applicator system from said first configuration to said second configuration for delivering adhesive from said passageway to said contact surface through said open slit, said adhesive applicator means including a holder element defining an opening at said contact surface and a hollow flexible element mounted on said holder element, said slit being formed in said hollow flexible element, and said slit being closely adjacent to and in at least partial registry with said opening, said holder element including a first holder element segment and a second holder element segment, said holder element segments being pivotal relative to each other about a predetermined pivot axis, said hollow flexible element having separate sections thereof fixedly mounted on each of said holder element segments, and relative pivotal movement between said holder element segments operable to bend said hollow flexible element to selectively open or close said slit.

2. The apparatus according to claim 1 wherein said hollow flexible element comprises a tube, said tube extending from said holder element and comprising at least a portion of said passageway defining means.

3. The apparatus according to claim 1 wherein said holder element is of unitary construction and wherein said holder element segments are integral with each other.

4. The apparatus according to claim 1 wherein said contact surface defines a notch in said first holder element segment.

5. The apparatus according to claim 4 wherein said first holder element segment defines a line of cut communicating with said opening and in substantial alignment with said slit.

6. The apparatus according to claim 5 wherein said holder element is of integral construction and defines a groove at least partially defining said first and second holder element segments, said groove extending into said holder element from a side of said holder element in general opposition to a side of said holder element at which said notch is located, said groove terminating at said predetermined pivot location.

7. The apparatus according to claim 6 wherein said predetermined pivot axis is spaced from and generally parallel to said slit and said line of cut.

8. The apparatus according to claim 1 wherein said apparatus additionally comprises sheet material engagement means for engaging sheet material and forming a nip with said contact surface to maintain said sheet material in contact with said contact surface.

9. The apparatus according to claim 8 wherein said contact surface includes at least two converging contact surface sections defining a notch in said holder element, said notch having a predetermined cross-sectional configuration, and said sheet material engagement means having a sheet material engaging surface with a cross-sectional configuration generally corresponding to the predetermined cross-sectional configuration of said notch.

10. The apparatus according to claim 9 wherein said predetermined cross-sectional configuration is generally V-shaped.

* * * * *